US011542683B2

(12) United States Patent
Kang

(10) Patent No.: US 11,542,683 B2
(45) Date of Patent: Jan. 3, 2023

(54) CONSTRUCTION MACHINE

(71) Applicant: DOOSAN INFRACORE CO., LTD., Incheon (KR)

(72) Inventor: Byung Il Kang, Incheon (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 0 days.

(21) Appl. No.: 17/430,680

(22) PCT Filed: Feb. 12, 2020

(86) PCT No.: PCT/KR2020/001984
§ 371 (c)(1),
(2) Date: Aug. 12, 2021

(87) PCT Pub. No.: WO2020/166975
PCT Pub. Date: Aug. 20, 2020

(65) Prior Publication Data

US 2022/0145578 A1 May 12, 2022

(30) Foreign Application Priority Data

Feb. 13, 2019 (KR) ..... 10-2019-0016546

(51) Int. Cl.
*E02F 9/22* (2006.01)
*F15B 21/14* (2006.01)

(52) U.S. Cl.
CPC ..... *E02F 9/2217* (2013.01); *E02F 9/2239* (2013.01); *F15B 21/14* (2013.01);
(Continued)

(58) Field of Classification Search
CPC ..... F15B 21/14; F15B 2211/88; F15B 2211/355; F15B 2211/613; F15B 2211/67; E02F 9/2217; E02F 9/2285
See application file for complete search history.

(56) References Cited

U.S. PATENT DOCUMENTS 7,634,911 B2 * 12/2009 Brinkman ..... E02F 9/2217 91/533
9,175,698 B2 11/2015 Oguma et al.
(Continued)

FOREIGN PATENT DOCUMENTS

CN 102588362 A 7/2012
CN 103184752 A 7/2013
(Continued)

OTHER PUBLICATIONS

JP 4937176 B2 machine translation to English from espacenet (Year: 2012).*

(Continued)

*Primary Examiner* — Dustin T Nguyen
*Assistant Examiner* — Michael Quandt
(74) *Attorney, Agent, or Firm* — Hauptman Ham, LLP

(57) ABSTRACT

A construction machine according to an exemplary embodiment of the present invention includes: an engine; a boom cylinder which is divided into a head side and a rod side; a regeneration line through which hydraulic fluid discharged from the head side of the boom cylinder moves when the boom descends; a regeneration motor which is connected with the regeneration line and is operated, and assists the engine; a pilot pump which generates a pilot pressure; a pilot line through which pilot hydraulic fluid discharged from the pilot pump moves; a regeneration connection line which connects the pilot line and the regeneration line; an on/off valve installed in the regeneration connection line; and a control device which closes the on/off valve when a pressure of the pilot line drops below a predetermined pressure or the hydraulic fluid discharged from the boom cylinder is supplied to the regeneration motor.

12 Claims, 6 Drawing Sheets

(52) U.S. Cl.
CPC ..... *F15B 2211/613* (2013.01); *F15B 2211/67* (2013.01); *F15B 2211/88* (2013.01)

(56) References Cited

U.S. PATENT DOCUMENTS

| | | | | |
|---|---|---|---|---|
| 10,024,341 | B2 | 7/2018 | Zhang et al. | |
| 10,301,793 | B2 | 5/2019 | Hijikata et al. | |
| 10,604,915 | B2 | 3/2020 | Joo | |
| 10,655,647 | B2 * | 5/2020 | Takebayashi ..... | E02F 9/2285 |

FOREIGN PATENT DOCUMENTS

| | | | | |
|---|---|---|---|---|
| CN | 107076181 | A | | 8/2017 |
| CN | 108368691 | A | | 8/2018 |
| CN | 109790860 | A | | 5/2019 |
| JP | 2003120616 | A | * | 4/2003 |
| JP | 2009-243554 | A | | 10/2009 |
| JP | 4937176 | B2 | * | 5/2012 |
| JP | 2018-145984 | A | | 9/2018 |
| JP | 6442270 | B2 | | 12/2018 |
| KR | 10-1273086 | B1 | | 6/2013 |
| KR | 10-2017-0066085 | A | | 6/2017 |
| KR | 10-2018-0110037 | A | | 10/2018 |

OTHER PUBLICATIONS

JP 2003120616 A machine translation to English from espacenet (Year: 2003).*

International Search Report dated Jun. 30, 2020, corresponding to International Application No. PCT/KR2020/001984.

Office Action dated Apr. 19, 2022, in connection with Chinese Patent Application No. 202080013915.X, along with English machine translation.

* cited by examiner

CONSTRUCTION MACHINE

CROSS-REFERENCE TO RELATED APPLICATION

This present application is a national stage filing under 35 U.S.C. § 371 of PCT application number PCT/KR2020/001984 filed on Feb. 12, 2020, which is based upon and claims the benefit of priority to Korean Patent Application No. 10-2019-0016546 filed Feb. 13, 2019 in the Korean Intellectual Property Office. The disclosures of the above-listed applications are hereby incorporated by reference herein in their entireties.

TECHNICAL FIELD

The present invention relates to a construction machine, and more particularly, to a construction machine which improves fuel efficiency by recovering potential energy of a boom when the boom descends.

BACKGROUND ART

A construction machine broadly refers to all machines used in civil engineering or building works. In general, a construction machine includes an engine, and a hydraulic pump operated by the power of the engine, and travels or drives a work device with the power generated through the engine and the hydraulic pump.

For example, an excavator, a type of construction machine, is a construction machine that performs work, such as excavating work to dig the ground in civil engineering, building, and construction sites, loading work to transport soil, cracking work to dismantle buildings, and grading work to clear the ground, and is formed of a travelling body that moves equipment, an upper swing body mounted to the travelling body and rotating 360°, and a working device.

Further, the excavator includes a travelling motor used for travelling, a swing motor used for swinging the upper swing body, and driving devices, such as a boom cylinder, an arm cylinder, a bucket cylinder, and an option cylinder used for the working device. Further, the driving devices are driven by hydraulic fluid discharged from a variable capacity-type hydraulic pump driven by an engine or an electric motor.

Recently, an energy regeneration system, which recovers potential energy of a working device and utilizes the recovered energy as an auxiliary means in the operations of various driving devices is applied to a construction machine.

When the working device, such as the boom, moves up and down by the boom cylinder, when the raised boom is lowered, the hydraulic fluid on the head side of the boom cylinder is pushed out from the boom cylinder at high pressure by the potential energy of the boom. The high-pressure hydraulic fluid is converted into thermal energy and dissipated or returned to a storage tank, so that the potential energy of the boom disappears.

Accordingly, the energy regeneration system accumulates the high-pressure hydraulic fluid in an accumulator and then operates the regeneration motor with the accumulated hydraulic fluid, thereby reducing fuel efficiency of the engine that drives the hydraulic pump.

However, when the regeneration motor performs a regeneration operation by the hydraulic fluid discharged from the working device, the regeneration motor is connected with the engine to assist the engine, but when the regeneration motor does not perform the regeneration operation, the regeneration motor applies a load on the engine. As described above, when the regeneration motor unnecessarily increases the load on the engine, there occurs a problem in that fuel efficiency of the engine is reduced.

DISCLOSURE

Technical Problem

An exemplary embodiment of the present invention provides a construction machine which improves overall energy use efficiency by increasing an operation rate of a regeneration motor.

Technical Solution

According to an exemplary embodiment of the present invention, a construction machine includes: an engine which generates power; a boom cylinder which ascends a boom, and is divided into a head side and a rod side; a regeneration line which is connected to the head side of the boom cylinder and through which hydraulic fluid discharged from the head side of the boom cylinder moves when the boom descends; a regeneration motor which is connected with the regeneration line and is operated, and assists the engine; a pilot pump which generates a pilot pressure; a pilot line through which pilot hydraulic fluid discharged from the pilot pump moves; a regeneration connection line which connects the pilot line and the regeneration line; an on/off valve installed in the regeneration connection line; and a control device which closes the on/off valve when a pressure of the pilot line drops below a predetermined pressure or the hydraulic fluid discharged from the boom cylinder is supplied to the regeneration motor.

The construction machine may further include a pilot pressure sensor which measures a pressure of the pilot line. Further, the control device may receive pressure information of the pilot line from the pilot pressure sensor.

The construction machine may further include a check valve which is installed in the regeneration connection line and blocks the hydraulic fluid from moving from the regeneration line to the pilot line.

Further, the construction machine may further include: a pilot discharge line connected with the pilot line; and a pilot relief valve which is installed in the pilot discharge line, and is opened when the pressure of the pilot line exceeds the predetermined pressure.

Further, the construction machine may further include: a circulation line which is branched from the regeneration line and is connected to the rod side of the boom cylinder; and a boom regeneration value including a first regeneration spool installed in the regeneration line and a second regeneration spool installed in the circulation line. Further, the control device may move the first regeneration spool and the second regeneration spool to an opening position when the boom descends and move the first regeneration spool and the second regeneration spool to a blocking position when the boom ascends.

Further, the construction machine may further include: an accumulator which accumulates the hydraulic fluid discharged from the boom cylinder; an energy storage line which connects the accumulator and the regeneration line; and an accumulator valve installed in the energy storage line. The control device may close the on/off valve even when the hydraulic fluid accumulated in the accumulator is supplied to the regeneration motor.

Further, the construction machine may include: a main pump which is driven by the engine and discharges hydraulic fluid; a main control valve which receive the pilot pressure generated by the pilot pump and controls supply of the hydraulic fluid to the boom cylinder; a main hydraulic line which connects the main pump and the main control valve; and a first boom hydraulic line which connects the main control valve and the head side of the boom cylinder, and a second boom hydraulic line which connects the main control valve and the rod side of the boom cylinder.

According to another exemplary embodiment of the present invention, a construction machine includes: an engine which generates power; a boom cylinder which ascends a boom, and is divided into a head side and a rod side; a regeneration line which is connected to the head side of the boom cylinder and through which hydraulic fluid discharged from the head side of the boom cylinder moves when the boom descends; a variable capacity-type regeneration motor which is operated while being connected with the regeneration line and assists the engine; a pilot pump which generates a pilot pressure; a pilot line through which pilot hydraulic fluid discharged from the pilot pump moves; a regenerative connection line which connects the pilot line and the regenerative line; a check valve which is installed in the regeneration connection line and blocks the hydraulic fluid from moving from the regeneration line to the pilot line; and a control device which controls a swash plate angle of the regeneration pump so as to prevent the hydraulic fluid from flowing into the regeneration pump when the pressure of the pilot line drops below a predetermined pressure when the boom is in operation other than descending.

Further, the construction machine may further include a pilot pressure sensor which measures a pressure of the pilot line. Further, the control device may receive pressure information of the pilot line from the pilot pressure sensor.

Further, the construction machine may further include: a pilot discharge line connected with the pilot line; and a pilot relief valve which is installed in the pilot discharge line, and is opened when the pressure of the pilot line exceeds the predetermined pressure.

Further, the construction machine may further include: a circulation line which is branched from the regeneration line and is connected to the rod side of the boom cylinder; and a boom regeneration value including a first regeneration spool installed in the regeneration line and a second regeneration spool installed in the circulation line. Further, the control device may move the first regeneration spool and the second regeneration spool to an opening position when the boom descends and move the first regeneration spool and the second regeneration spool to a blocking position when the boom ascends.

The construction machine may further include: an accumulator which accumulates the hydraulic fluid discharged from the boom cylinder; an energy storage line which connects the accumulator and the regeneration line; and an accumulator valve installed in the energy storage line. Further, when the hydraulic fluid accumulated in the accumulator is supplied to the regeneration motor, the control device may control the swash plate angle of the regeneration pump so that the hydraulic fluid flows into the regeneration pump even when the pressure of the pilot line drops below the predetermined pressure.

The construction machine may further include: a main pump which is driven by the engine and discharges hydraulic fluid; a main control valve which receive the pilot pressure generated by the pilot pump and controls supply of the hydraulic fluid to the boom cylinder; a main hydraulic line which connects the main pump and the main control valve; and a first boom hydraulic line which connects the main control valve and the head side of the boom cylinder, and a second boom hydraulic line which connects the main control valve and the rod side of the boom cylinder.

Advantageous Effects

According to the exemplary embodiment of the present invention, the construction machine may improve overall energy use efficiency by increasing an operate rate of a regeneration motor.

BEST MODE

Figure 1:
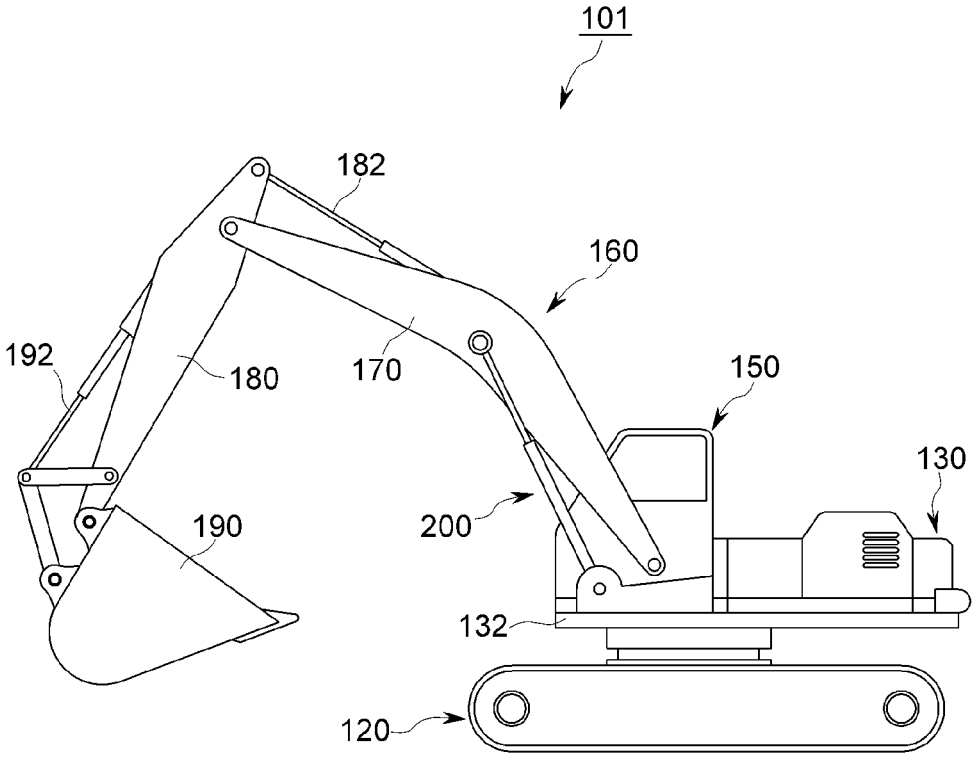
FIG. 1 is a lateral view of a construction machine according to a first exemplary embodiment of the present invention.

Hereinafter, an exemplary embodiment of the present invention will be described in detail with reference to accompanying drawings so as for those skilled in the art to easily carry out. The present invention can be implemented in various forms and is not limited to the exemplary embodiment described herein.

Further, in some exemplary embodiments, the constituent elements having the same configuration will be representatively described in the first embodiment using the same reference numerals, and only configurations different from those of the first exemplary embodiment will be described in other exemplary embodiments.

It should be noted that the drawings are schematic and not drawn to scale. Relative dimensions and proportions of parts in the drawings are shown exaggerated or reduced in size for clarity and convenience in the drawing, and a predetermined dimension is simply illustrative only and not limiting. Further, the same reference numerals are used for the same structure, element, or component shown in the two or more drawings in order to denote like features.

An exemplary embodiment of the present invention specifically represents an ideal embodiment of the present invention. As a result, various modifications of the drawings are expected. Accordingly, the exemplary embodiment is not limited to a specific form of the illustrated area, and includes, for example, a shape modification by manufacturing.

Hereinafter, a construction machine 101 according to a first exemplary embodiment of the present invention with reference to FIGS. 1 to 3.

In the present specification, the construction machine 101 is described with an excavator as an example. However, the construction machine 101 is not limited to the excavator, and the present invention is applicable to all of the construction machines in which a working device 160, such as a boom 170, generating potential energy is mounted.

As illustrated in FIG. 1, the construction machine 101 may include a lower travelling body 120, an upper swing body 130 mounted on the lower travelling body 120 so as to be able to swing, and an operating room 150 and the working device 160 installed in the upper swing body 130.

Figure 2:
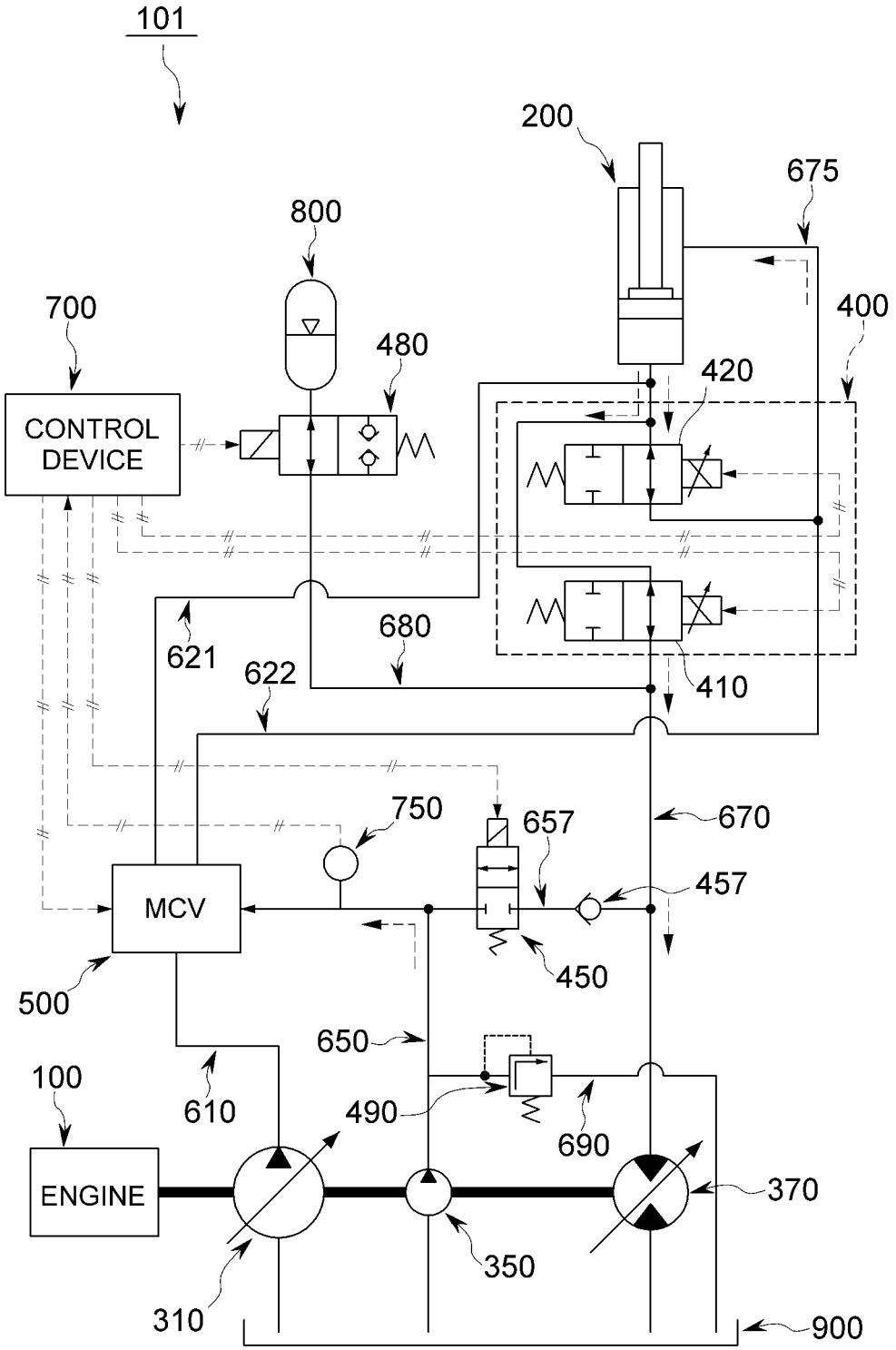
FIG. 2 is a hydraulic circuit diagram illustrating a hydraulic system used in the construction machine of FIG. 1.

The lower traveling body 120 may support the upper swing body 130, and travel the construction machine 101 through a travelling device by using power generated in an engine 100 (illustrated in FIG. 2). The lower travelling body 120 may be the caterpillar type travelling body including a caterpillar or a wheel type travelling body including travelling wheels.

The upper swing body 130 may rotate on the lower travelling body 120 and set an operation direction. The upper swing body 130 may include an upper frame 132, and the operating room 150 and the working device 160 installed in the upper frame 132.

The working device 160 may include a boom 170, an arm 180, and a bucket 190. A boom cylinder 200 for controlling a movement of the boom 170 may be installed between the boom 170 and the upper frame 132. Further, an arm cylinder 182 for controlling a movement of the arm 180 may be installed between the boom 170 and the arm 180, and the bucket cylinder 192 for controlling the movement of the bucket 190 may be installed between the arm 180 and the bucket 190.

The boom 170, the arm 180, and the bucket 190 may implement various movements according to the extension and the contraction of the boom cylinder 200, the arm cylinder 182, and the bucket cylinder 192, and the working device 160 may perform various work. In this case, the boom cylinder 200, the arm cylinder 182, and the bucket cylinder 192 are operated by hydraulic fluid supplied from a main pump 310 (illustrated in FIG. 2) which is to be described below.

As illustrated in FIG. 2, the hydraulic system used in the construction machine 101 according to the first exemplary embodiment of the present invention includes the engine 100, the boom cylinder 200, a regeneration line 670, a regeneration motor 370, a pilot pump 350, a pilot line 650, a regeneration connection line 657, an on/off valve 450, and a control device 700.

Further, the hydraulic system used in the construction machine 101 according to the first exemplary embodiment of the present invention may further include a check valve 457, a pilot discharge line 690, a pilot relief valve 490, a pilot pressure sensor 750, a circulation line 675, a boom regeneration valve 400, an accumulator 800, an energy storage line 680, an accumulator valve 480, the main pump 310, a main control valve (MCV) 500, a main hydraulic line 610, a first boom hydraulic line 621, a second boom hydraulic line 622, and a hydraulic fluid tank 900.

The engine 100 generates power by combusting fuel. That is, the engine 100 supplies rotation power to the main pump 310 which is to be described below.

The main pump 310 operates with the power generated by the engine 100 and discharge hydraulic fluid. The hydraulic fluid discharged from the main pump 310 may be supplied to various working devices 160 including the boom cylinders 200 which is to be described below. Further, the main pump 310 may be a variable capacity-type pump of which a flow rate discharged is variable according to an angle of a swash plate.

Hereinafter, in the present specification, the boom cylinder 200 among various working devices 160 will be described as an example. The boom cylinder 200 ascends the boom 170, and is divided into a head side and a rod side.

The MCV 500 controls the supply of the hydraulic fluid to various working devices 160 including the boom cylinders 200. In particular, the main control valve 500 may include a plurality of control spools. Further, each of the control spools controls a supply of the hydraulic fluid to various working devices including the boom cylinders 200. Further, the MCV 500 may further include spool caps (not illustrated) which are connected to both ends of the control spool, respectively, and receive pilot pressure of a manipulation device which is to be described below and stroke the control spool. For example, in the spool cap, an Electronic Proportional Pressure Reducing Valve (EPPRV) may be installed, and the pilot pressure exerts a different pressure on the control spool according to the degree of opening/closing of the EPPRV, and the control spool moves in both directions by the pressure applied by the pilot pressure.

The main hydraulic line 610 connects the main pump 310 and the main control valve 500. That is, the main hydraulic line 610 delivers the hydraulic fluid discharged by the main pump 310 to the main control valve 500 so that the main control valve 500 distributes the hydraulic fluid to the various working devices and travelling devices and control the hydraulic fluid.

The pilot pump 350 generates the pilot pressure for controlling the devices including the main control valves 500. The pilot pressure generated in the pilot pump 350 may be controlled according to a manipulation device (not illustrated) or the control device 700 and delivered to various devices including the main control valves 500. For example, the pilot pressure generated by the pilot pump 350 may be adjusted by the manipulation device or the control device 700 and delivered to various hydraulic devices and various valves. Herein, the manipulation device refers to a joystick, a manipulation lever, a pedal, and the like installed in the operating room 150 so that an operator is capable of manipulating various working devices 160 and the travelling device. The manipulation device is manipulated and delivers the pilot pressure to the main control valve 500 according to an intention of the operator. Further, the main control valve 500 may adjust the hydraulic fluid supplied to various working devices 160 according to the pilot pressure received through the manipulation device. Further, the control device 700 may also automatically deliver the pilot pressure to the main control valve 500 if necessary. Further, the amount of hydraulic fluid discharged of the pilot pump 350 is relatively smaller than that of the main pump 310.

The pilot line 650 delivers the pilot pressure generated in the pilot pump 350. In this case, when the manipulation device or the control device 700 does no operation, the pilot line is maintained at a constant pressure set in the relief valve 490.

The pilot pressure sensor 750 measures a pressure of the pilot line 650. Further, the pilot pressure sensor 750 may measure pressure information of the pilot line 650 and transmit the measured pressure information to the control device 700.

The pilot discharge line 690 connects the pilot line 650 and the hydraulic fluid tank 900.

The pilot relief valve 490 is installed in the pilot discharge line 690, and when the pressure of the pilot line 650 exceeds a predetermined pressure, the pilot relief valve 490 is opened. That is, the pilot relief valve 490 is used for constantly maintaining the pressure of the output end of the pilot pump 350 and the pressure of the pilot line 650. Herein, the predetermined pressure may be set according to the general specification of the hydraulic system. For example, the predetermined pressure needs to be at least a pressure enough to allow the pilot hydraulic fluid to stably move various spools of the main control valve 500.

The hydraulic fluid tank 900 recovers the used hydraulic fluid discharged from the main pump 310 and the pilot pump 350 and stores the hydraulic fluid so as to supply the hydraulic fluid to the main pump 310 and the pilot pump 350 again.

The boom cylinder 200 drives the boom 170 that is one of the working devices 160 in a vertical direction. That is, the boom cylinder 200 ascends the boom 170. Further, the boom cylinder 200 is divided into a head side 201 and a rod side 202.

The first boom hydraulic line 621 connects the main control valve 500 and the head side 201 of the boom cylinder 200, and the second boom hydraulic line 622 connects the main control valve 500 and the rod side 202 of the boom cylinder 200. In particular, the first boom hydraulic line 621 is connected to the head side 201 of the boom cylinder 200 to supply the hydraulic fluid to the boom cylinder 200 when the boom 170 ascends. Further, the second boom hydraulic line 622 is connected to the rod side 202 of the boom cylinder 200 to supply the hydraulic fluid to the boom cylinder 200 when the boom 170 descends.

The regeneration line 670 is branched from the first boom hydraulic line 621 and moves the hydraulic fluid discharged from the head side 201 of the boom cylinder 200 when the boom 170 descends. Further, the regeneration line 670 is connected with the regeneration motor 370 which is to be described below. That is, the hydraulic fluid which has been discharged from the boom cylinder 200 and moved along the regeneration line 670 operates the regeneration motor 370.

The circulation line 675 is branched from the regeneration line 670 and is connected with the second boom hydraulic line 622. Accordingly, when the boom 170 descends, some of the hydraulic fluid discharged from the head side 201 of the boom cylinder 200 moves along the circulation line 675 and then flows into the rod side 202 of the boom cylinder 200 via the second boom hydraulic line 622. As described above, the hydraulic fluid discharged from the head side 201 of the boom cylinder 200 flows into the road side 202 of the boom cylinder 200 when the boom 170 descends, it is possible to increase a descending speed of the boom 170 and improve energy use efficiency.

The boom regeneration valve 400 includes a first regeneration spool 410 installed in the regeneration line 670 and a second regeneration spool 420 installed in the circulation line 675. Further, the first regeneration spool 410 and the second regeneration spool 420 may open/close the regeneration line 670 and the circulation line 675, respectively, and adjust passage flow rates. For example, the control device 700 which is to be described below may move the first regeneration spool 410 and the second regeneration spool 420 to an opening position when the boom 170 descends, and move the first regeneration spool 410 and the second regeneration spool 420 to a blocking position when the boom 170 ascends.

The regeneration motor 370 is connected with the regeneration line 670 and is operated with the pressure of the hydraulic fluid received through the regeneration line 670. The regeneration motor 370 may drive the main pump 310 by assisting the engine 100. That is, the fuel efficiency of the engine 100 may be reduced as much as the regeneration motor 370 drives the main pump 310. Further, the regeneration motor 370 may have a variable capacity type, and a swash plate angle may be adjusted according to a signal of the control device 700.

For example, the engine 100, the main pump 310, the pilot pump 350, and the regeneration motor 370 may be directly connected.

The accumulator 800 is connected with the regeneration line 670 to accumulate the hydraulic fluid discharged from the boom cylinder 200. The accumulator 800 is the device which stores high-pressure hydraulic fluid in the hydraulic system.

The energy storage line 680 connects the accumulator 800 and the regeneration line 670, and the accumulator valve 480 is installed in the energy storage line 680 and opens/closes the energy storage line 680. The accumulator valve 480 is controlled by the control device 700 which is to be described below, and is opened when the boom 170 descends and the regeneration motor 370 is driven by using the high-pressure hydraulic fluid stored in the accumulator 800.

The regeneration connection line 657 connects the pilot line 650 and the regeneration line 670. The on/off valve 450 is installed in the regeneration connection line 657. Further, the check valve 457 is installed in the regeneration connection line 657, thereby blocking the hydraulic fluid from moving from the regeneration line 670 to the pilot line 650.

The control device 700 may control various configurations of the construction machine 101, such as the engine 100, the main pump 310, the regeneration motor 370, and the main control valve 500. Further, the control device 700 may include one or more of an Engine Control Unit (ECU) and a Vehicle Control Unit (VCU).

In particular, in the first exemplary embodiment of the present invention, when the pressure of the pilot line 650 reaches a predetermined pressure, the control device 700 opens the on/off valve 450, and when the pressure of the pilot line 650 drops below the predetermined pressure or the hydraulic fluid discharged from the boom cylinder 200 is supplied to the regeneration motor 370, the control device 700 closes the on/off valve 450.

In the foregoing configuration, when the on/off valve 450 is opened, the pilot flow rate, that is, the pilot hydraulic fluid, supplied by the pilot pump 350 may be moved through the regeneration connection line 657 to be utilized for driving the regeneration motor 370.

However, when the pressure of the pilot line 650 drops below the predetermined pressure the main control valve 500 and the like that are operated according to the pilot pressure supplied by the pilot pump 350 may not perform a normal function. That is, the response speed of the main control valve 500 may be slowed down or malfunction may occur due to the pressure drop of the pilot hydraulic fluid. Accordingly, the control device 700 checks the pressure of the pilot line 650 through the pilot pressure sensor 750 in real time, and when the pressure of the pilot line 650 drops below the predetermined pressure, the control device 700 closes the on/off valve 450 and prevents the pressure of the pilot line 650 from dropping.

Further, when the on/off valve 450 is opened when the boom 170 descends, the hydraulic fluid may move to the pilot line 650 according to the regeneration line 670. This is because the pressure of the hydraulic fluid generated when the boom 170 descends is relatively much greater than the pressure of the hydraulic fluid supplied by the pilot pump 350. The reverse flow may be prevented through the check valve 457 or by closing the on/off valve 450. However, when the check valve 457 is installed, the control device 700 does not necessarily close the on/off valve 450 when the boom 170 descends.

Further, when there is no check valve 457, the control device 700 closes the on/off valve 450 even when the hydraulic fluid accumulated in the accumulator 800 is supplied to the regeneration motor 370.

In the meantime, when the hydraulic fluid is not supplied from the boom cylinder 200 or the accumulator 800, the on/off valve 450 is not always opened. For example, when the regeneration motor 370 is driven with the pressure of the pilot line 650, in the situation where it is difficult to maintain the pressure of the pilot line 650 with the predetermined pressure, the control device 700 closes the on/off valve 450, and in this case, the pressure of the pilot line 650 is adjusted only with the pilot relief valve 490.

Further, when the on/off valve 450 is opened and the control device 700 drives the regeneration motor 370 with the pilot hydraulic fluid supplied by the pilot pump 350 or drives the regeneration motor 370 by using the hydraulic fluid accumulated in the accumulator 800, or when the boom 170 descends, the control device 700 increases the swash plate angle of the regeneration motor 370, and in the case of other operations, the swash plate angle of the regeneration motor 370 is maintained at the minimum swash plate angle. For example, the minimum swash plate angle may be 0°.

The swash plate angle of the regeneration motor 370 in the case where the on/off valve 450 is opened and the regeneration motor 370 is driven with the pilot hydraulic fluid supplied by the pilot pump 350 may be set to be different from the swash plate angle of the regeneration motor 370 in the case where the regeneration motor 370 is driven by using the energy stored in the accumulator 800 or the boom 170 descends. That is, the control device 700 may adjust the swash plate angle of the regeneration motor 370 to the most efficient angle in consideration of the flow rate of the hydraulic fluid supplied to the regeneration motor 370.

By the foregoing configuration, the construction machine 101 according to the first exemplary embodiment of the present invention may improve overall energy use efficiency by increasing an operation rate of the regeneration motor 370.

In particular, during the regeneration operation, the regeneration motor 370 supporting the engine 100 is not in the regeneration operation, it is possible to minimize the phenomenon of unnecessarily increasing the load of the engine 100.

Hereinafter, an operation principal of the construction machine 101 according to the first exemplary embodiment of the present invention will be described with reference to FIGS. 2 to 4.

First, as illustrated in FIG. 2, the hydraulic fluid discharged from the boom cylinder 200 when the boom 170 descends moves along the regeneration line 670 and operates the regeneration motor 370. In this case, the swash plate angle of the regeneration motor 370 increases.

Further, the hydraulic fluid discharged from the boom cylinder 200 may also be stored in the accumulator 800. Further, as the hydraulic fluid is accumulated in the accumulator 800, the pressure of the accumulator 800 continuously increases and the pressure of the regeneration line 670 also increases in proportion to the increase in the pressure of the accumulator 800.

The hydraulic fluid accumulated in the accumulator 800 may operate the regeneration motor 370 by supplying the hydraulic fluid to the regeneration motor 370 even when the boom 170 does not descend.

Further, the control device 700 blocks the on/off valve 450 when the regeneration motor 370 is being operated by the hydraulic fluid supplied by the boom cylinder 200 or the accumulator 800. That is, the hydraulic fluid supplied to the regeneration motor 370 through the regeneration line 670 is prevented from reversely flowing into the pilot line 650 through the regeneration connection line 657 by closing the on/off valve 450. However, when the check valve 457 is installed in the regeneration connection line 657, it is not necessarily to close the on/off valve 450.

Figure 3:
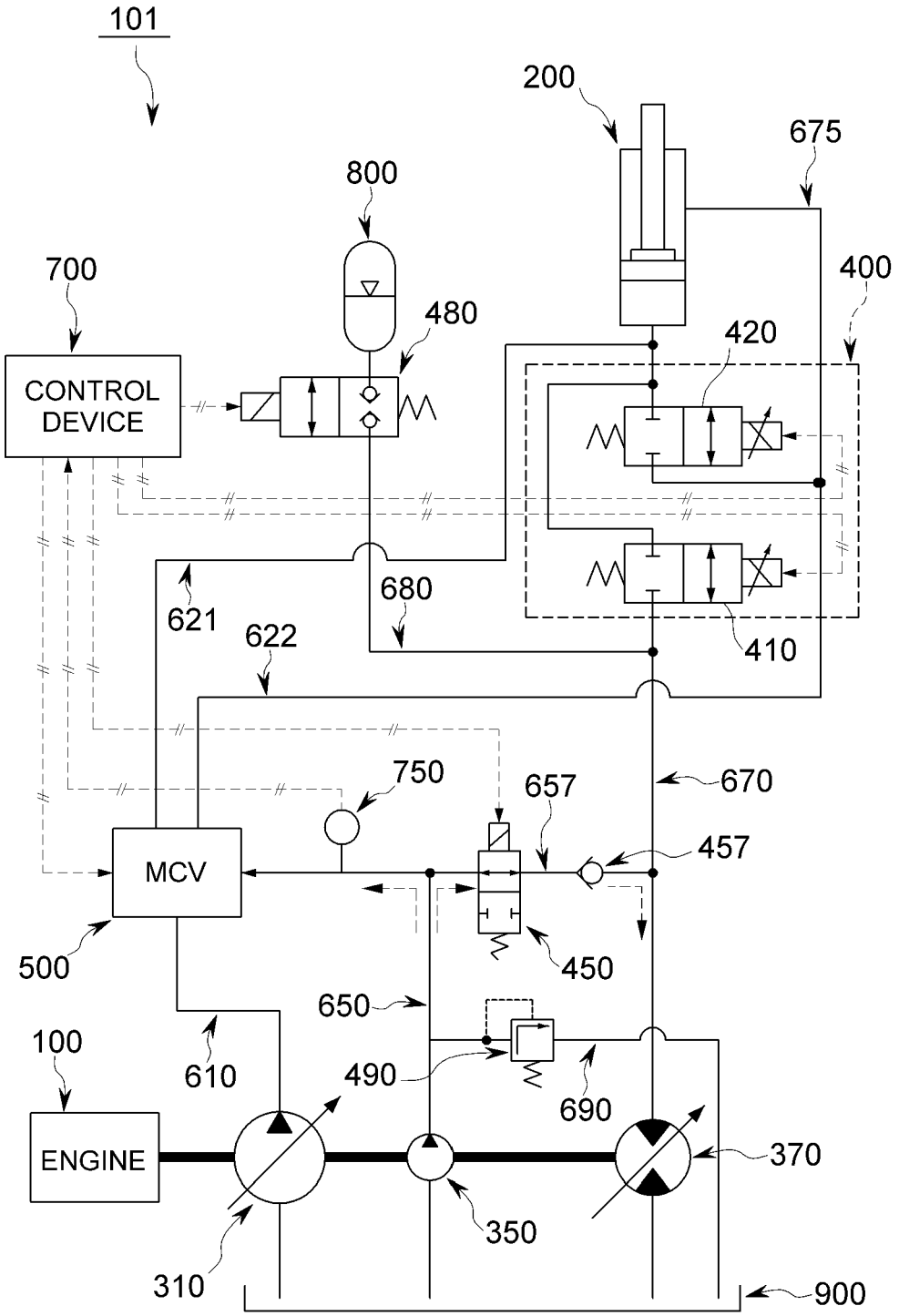
FIGS. 3 and 4 are hydraulic circuit diagrams illustrating an operation state of the hydraulic system used in the construction machine of FIG. 2.

Next, as illustrated in FIG. 3, when the boom cylinder 200 or the accumulator 800 does not supply the hydraulic fluid to the regeneration motor 370, the pilot flow rate, that is the pilot hydraulic fluid, moving to the pilot line 650 is supplied to the regeneration motor 370 by opening the on/off valve 450. The pilot line 650 is maintained at a predetermined pressure in order to deliver the pilot pressure, but when the manipulation device is not manipulated, the pilot hydraulic fluid is rarely used. Accordingly, the pilot hydraulic fluid discharged from the pilot pump 350 is discharged to the hydraulic fluid tank 900 via the pilot relief valve 490 while maintaining the pilot line 650 at the predetermined pressure.

Further, even though the manipulation device is manipulated, even when only a small portion of the pilot hydraulic fluid discharged from the pilot pump 350 is used because the amount of manipulation is not large, the remaining hydraulic fluid is discharged.

However, in the first exemplary embodiment of the present invention, as described above, the present invention recovers the meaninglessly discharged pilot hydraulic fluid and is used for operating the regeneration motor 370. In the state where the regeneration motor 370 is not operated, the regeneration motor 370 may act as a load on the engine 200 which rather reduces fuel efficiency of the engine 200. However, even when the boom 170 does not descend or the hydraulic fluid accumulated in the accumulator 800 is not used, the regeneration motor 370 is operated with the pilot hydraulic fluid, thereby increasing an operation rate of the regeneration motor 370 and minimizing a phenomenon in which the regeneration motor 370 acts as a load on the engine 100.

Further, the pilot hydraulic fluid discharged from the pilot pump 350 is basically used for moving various spools of the main control valve 500, so that the flow rate of the pilot hydraulic fluid flowing into the regeneration motor 370 may be decreased according to the amount of manipulation of the manipulation device.

In this case, the control device 700 may perform the control of maintaining the pressure of the pilot line 650 at the predetermined pressure and efficiently operating the regeneration motor 370 by decreasing the flow rate of the pilot hydraulic fluid flowing into the regeneration motor 370 by decreasing the swash plate angle of the regeneration motor 370.

Figure 4:
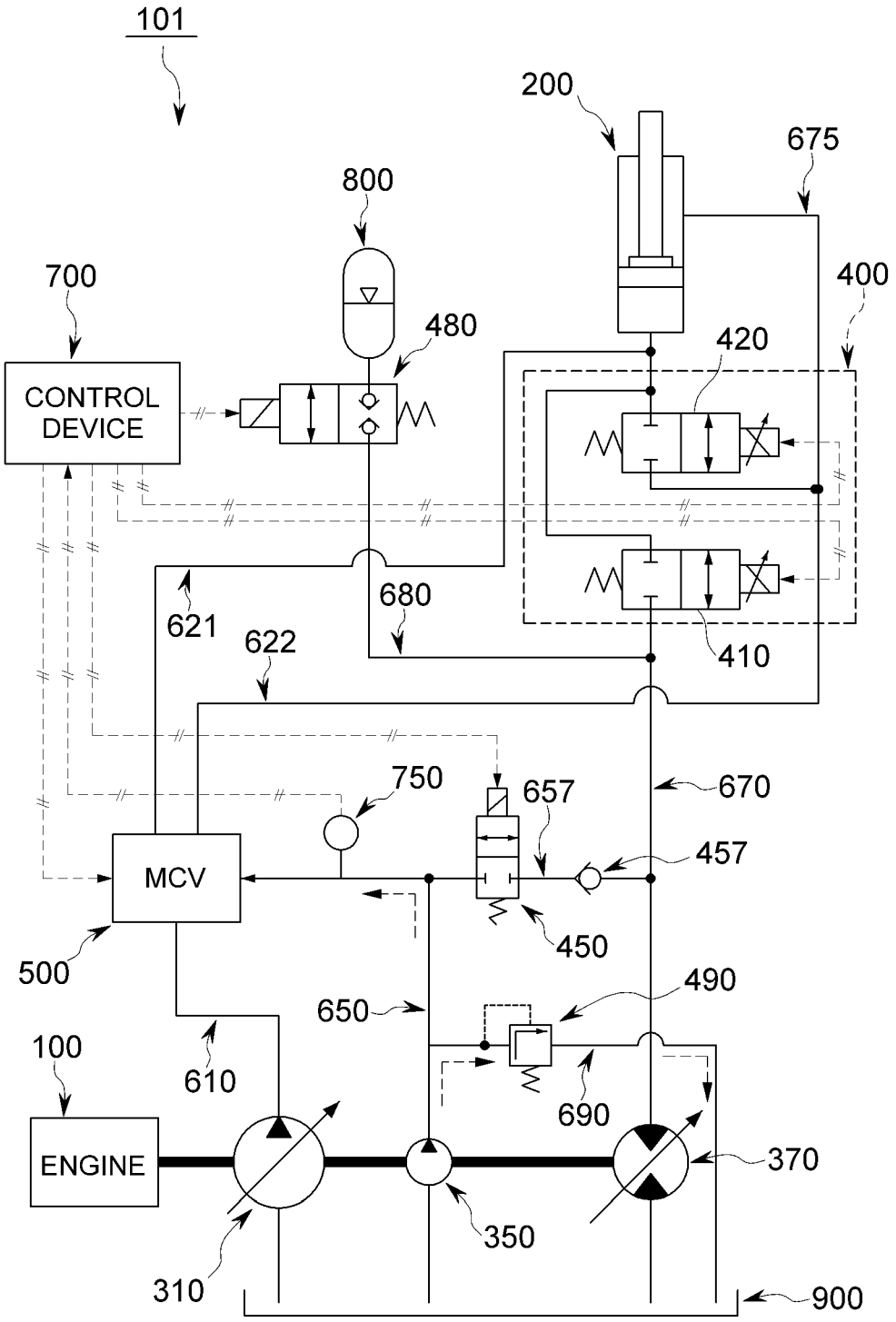

Further, in the case where it is difficult to maintain the pressure of the pilot line 650 at the predetermined pressure only by decreasing the swash plate angle of the regeneration motor 370 due to the increase in the amount of manipulation of the manipulation device, the control device 700 may close the on/off valve 450 and adjust the pressure of the pilot line 650 only with the pilot relief valve 490 as illustrated in FIG. 4.

Hereinafter, a construction machine 102 according to a second exemplary embodiment of the present invention will be described with reference to FIG. 5.

Figure 5:
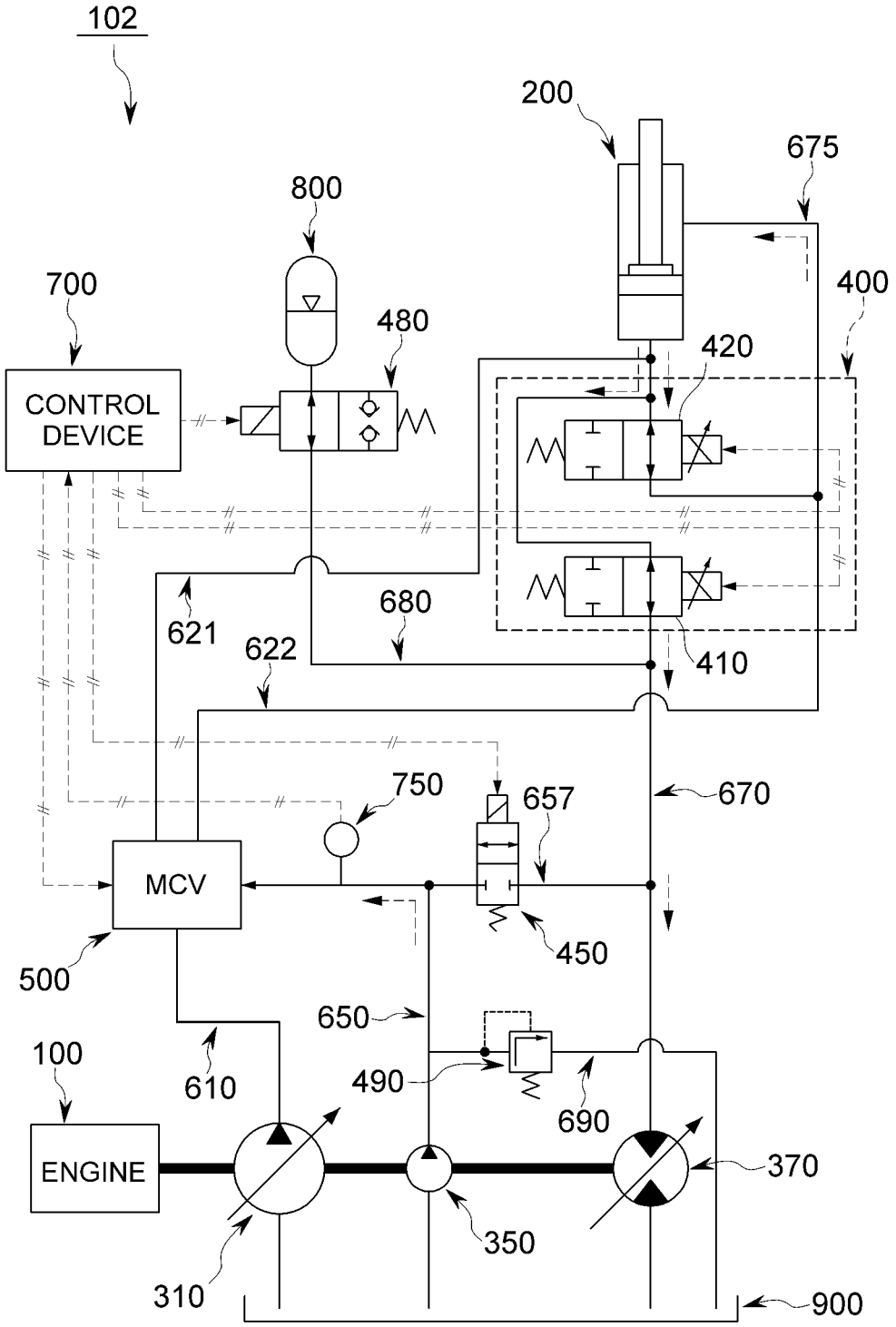
FIG. 5 is a hydraulic circuit diagram illustrating a hydraulic system used in a construction machine according to a second exemplary embodiment of the present invention.

As illustrated in FIG. 5, in the construction machine 102 according to the second exemplary embodiment of the present invention, the check valve 457 installed in the regeneration connection line 657 in the first exemplary embodiment is omitted. Further, other configurations of the construction machine 102 according to the second exemplary embodiment of the present invention are the same as those of the first exemplary embodiment.

As described above, in the second exemplary embodiment of the present invention, the check valve 457 is omitted, so that it is certainly necessary to block an on/off valve 450 in order to prevent hydraulic fluid supplied to a regeneration motor 370 through a regeneration line 670 when the regeneration motor 370 is being operated by the hydraulic fluid supplied by a boom cylinder 200 or an accumulator 800 from reversely flowing into a pilot line 650 through the regeneration connection line 657.

By the foregoing configuration, the construction machine 102 according to the second exemplary embodiment of the present invention may also improve overall energy use efficiency by increasing an operation rate of the regeneration motor 370.

In particular, during the regeneration operation, the regeneration motor 370 supporting the engine 100 is not in the regeneration operation, it is possible to minimize the phenomenon of unnecessarily increasing the load of the engine 100.

Hereinafter, a construction machine 103 according to a third exemplary embodiment of the present invention will be described with reference to FIG. 6.

Figure 6:
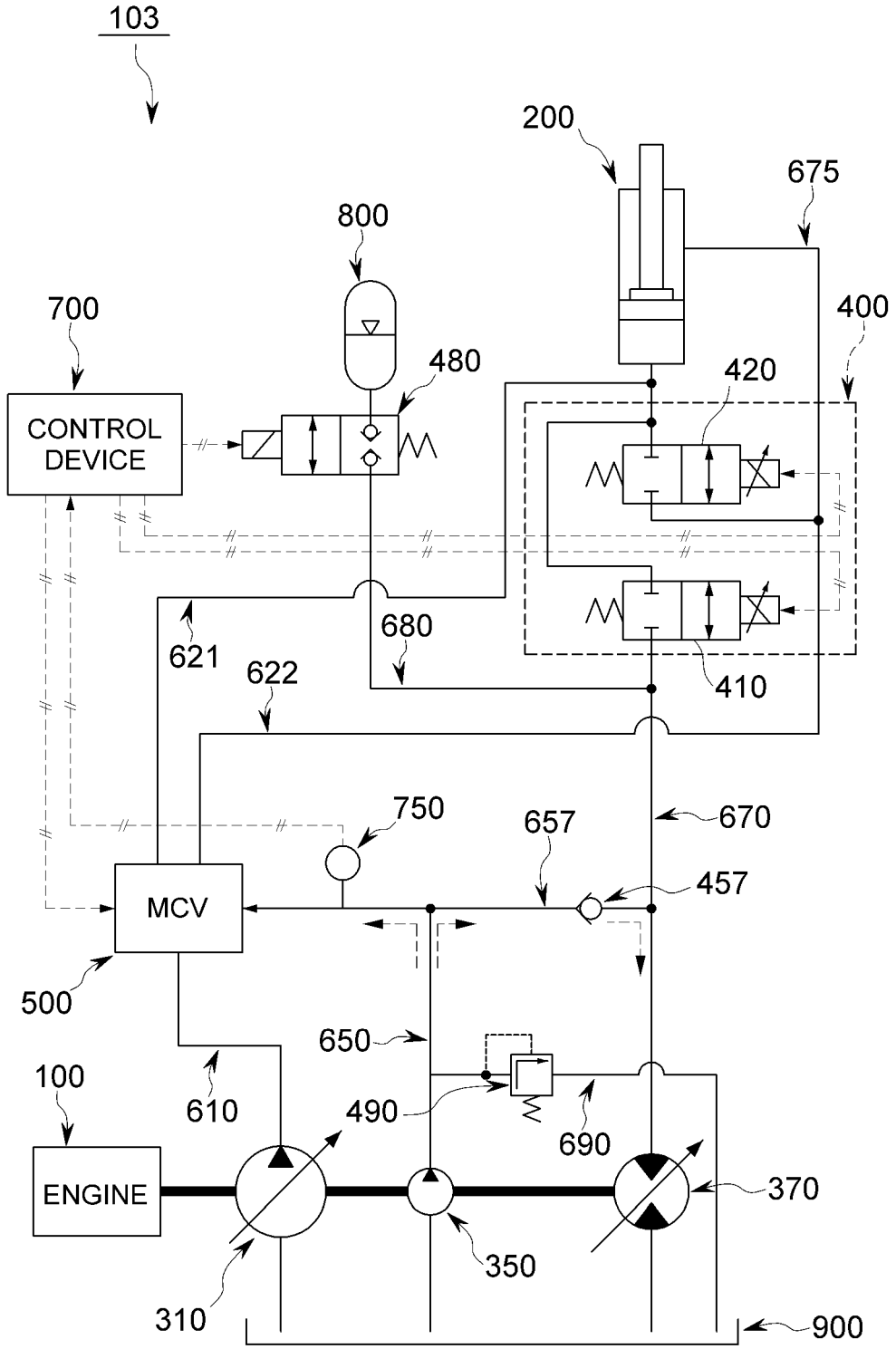
FIG. 6 is a hydraulic circuit diagram illustrating a hydraulic system used in a construction machine according to a third exemplary embodiment of the present invention.

As illustrated in FIG. 6, in the construction machine 103 according to the third exemplary embodiment of the present invention, the on/off valve 450 installed in the regeneration connection line 657 in the first exemplary embodiment is omitted. Further, other configurations of the construction machine 103 according to the third exemplary embodiment of the present invention are the same as those of the first exemplary embodiment.

As described above, in the third exemplary embodiment of the present invention, the on/off valve 450 is omitted, so that when the pressure of a pilot line 650 drops below a predetermined pressure during an operation other than the descending of a boom 170, a control device 700 prevents pilot hydraulic fluid from flowing into a regeneration pump 370 by controlling a swash plate angle of the regeneration pump 370 to recover the pressure of the pilot line 650 to the predetermined pressure. For example, the control device 700 may decrease the swash plate angle of the regeneration pump 370 to 0°.

Further, the reverse flowing of the hydraulic fluid supplied to the regeneration motor 370 through the regeneration line 670 into the pilot line 650 through the regeneration connection line 657 when the regeneration motor 370 is being operated by the hydraulic fluid supplied by a boom cylinder 200 or an accumulator 800 may be prevented through a check valve 457.

By the foregoing configuration, the construction machine 103 according to the third exemplary embodiment of the present invention may also improve overall energy use efficiency by increasing an operation rate of the regeneration motor 370.

In particular, during the regeneration operation, the regeneration motor 370 supporting the engine 100 is not in the regeneration operation, it is possible to minimize the phenomenon of unnecessarily increasing the load of the engine 100.

The exemplary embodiments of the present invention have been described with reference to the accompanying drawings, but those skilled in the art will understand that the present disclosure may be implemented in another specific form without changing the technical spirit or an essential feature thereof.

Accordingly, it will be understood that the aforementioned exemplary embodiments are described for illustrative and are not limited in all aspects, and it should be construed that the scope of the present disclosure shall be represented by the claims to be described below, and all of the changes or modified forms induced from the meaning and the scope of the claims, and an equivalent concept thereof are included in the scope of the present invention.

INDUSTRIAL APPLICABILITY

The construction machine according to the exemplary embodiment of the present invention may be used for improving overall energy use efficiency by increasing an operation rate of a regeneration motor.

The invention claimed is:

1. A construction machine, comprising:

an engine which generates power;

a boom cylinder which ascends a boom, and is divided into a head side and a rod side;

a regeneration line which is connected to the head side of the boom cylinder and through which hydraulic fluid discharged from the head side of the boom cylinder moves when the boom descends;

a regeneration motor which is connected with the regeneration line and is operated, and assists the engine;

a pilot pump which generates a pilot pressure;

a pilot line through which pilot hydraulic fluid discharged from the pilot pump moves;

a regenerative connection line which connects the pilot line and the regeneration line;

an on/off valve installed in the regenerative connection line;

a control device which closes the on/off valve when a pressure of the pilot line drops below a predetermined pressure or the hydraulic fluid discharged from the boom cylinder is supplied to the regeneration motor;

a circulation line which is branched from the regeneration line and is connected to the rod side of the boom cylinder; and a boom regeneration valve including a first regeneration spool installed in the regeneration line and a second regeneration spool installed in the circulation line, wherein the control device moves the first regeneration spool and the second regeneration spool to an opening position when the boom descends and moves the first regeneration spool and the second regeneration spool to a blocking position when the boom ascends.

2. The construction machine of claim 1, further comprising:

a pilot pressure sensor which measures a pressure of the pilot line, wherein the control device receives pressure information of the pilot line from the pilot pressure sensor.

3. The construction machine of claim 1, further comprising:

a check valve which is installed in the regenerative connection line and blocks the hydraulic fluid from moving from the regeneration line to the pilot line.

4. The construction machine of claim 1, further comprising:

a pilot discharge line connected with the pilot line; and a pilot relief valve which is installed in the pilot discharge line, and is opened when the pressure of the pilot line exceeds the predetermined pressure.

5. The construction machine of claim 1, comprising:

a main pump which is driven by the engine and discharges hydraulic fluid;

a main control valve which receive the pilot pressure generated by the pilot pump and controls supply of the hydraulic fluid to the boom cylinder;

a main hydraulic line which connects the main pump and the main control valve; and a first boom hydraulic line which connects the main control valve and the head side of the boom cylinder, and a second boom hydraulic line which connects the main control valve and the rod side of the boom cylinder.

6. A construction machine, comprising:

an engine which generates power;

a boom cylinder which ascends a boom, and is divided into a head side and a rod side;

a regeneration line which is connected to the head side of the boom cylinder and through which hydraulic fluid discharged from the head side of the boom cylinder moves when the boom descends;

a regeneration motor which is connected with the regeneration line and is operated, and assists the engine;

a pilot pump which generates a pilot pressure;

a pilot line through which pilot hydraulic fluid discharged from the pilot pump moves;

a regenerative connection line which connects the pilot line and the regeneration line;

an on/off valve installed in the regenerative connection line;

a control device which closes the on/off valve when a pressure of the pilot line drops below a predetermined pressure or the hydraulic fluid discharged from the boom cylinder is supplied to the regeneration motor;

an accumulator which accumulates the hydraulic fluid discharged from the boom cylinder; an energy storage line which connects the accumulator and the regeneration line; and an accumulator valve installed in the energy storage line, wherein the control device closes the on/off valve even when the hydraulic fluid accumulated in the accumulator is supplied to the regeneration motor.

7. A construction machine, comprising:

an engine which generates power;

a boom cylinder which ascends a boom, and is divided into a head side and a rod side;

a regeneration line which is connected to the head side of the boom cylinder and through which hydraulic fluid discharged from the head side of the boom cylinder moves when the boom descends;

a variable capacity-type regeneration motor which is operated while being connected with the regeneration line and assists the engine;

a pilot pump which generates a pilot pressure;

a pilot line through which pilot hydraulic fluid discharged from the pilot pump moves;

a regenerative connection line which connects the pilot line and the regenerative line;

a check valve which is installed in the regenerative connection line and blocks the hydraulic fluid from moving from the regeneration line to the pilot line; and a control device which controls a swash plate angle of the regeneration motor so as to prevent the hydraulic fluid from flowing into the regeneration motor when the pressure of the pilot line drops below a predetermined pressure when the boom is in operation other than descending.

8. The construction machine of claim 7, further comprising:

a pilot pressure sensor which measures a pressure of the pilot line, wherein the control device receives pressure information of the pilot line from the pilot pressure sensor.

9. The construction machine of claim 7, further comprising:

a pilot discharge line connected with the pilot line; and a pilot relief valve which is installed in the pilot discharge line, and is opened when the pressure of the pilot line exceeds the predetermined pressure.

10. The construction machine of claim 7, further comprising:

a circulation line which is branched from the regeneration line and is connected to the rod side of the boom cylinder; and a boom regeneration valve including a first regeneration spool installed in the regeneration line and a second regeneration spool installed in the circulation line, wherein the control device moves the first regeneration spool and the second regeneration spool to an opening position when the boom descends and moves the first regeneration spool and the second regeneration spool to a blocking position when the boom ascends.

11. The construction machine of claim 7, further comprising:

an accumulator which accumulates the hydraulic fluid discharged from the boom cylinder;

an energy storage line which connects the accumulator and the regeneration line; and an accumulator valve installed in the energy storage line, wherein when the hydraulic fluid accumulated in the accumulator is supplied to the regeneration motor, the control device controls the swash plate angle of the regeneration motor so that the hydraulic fluid flows into the regeneration motor even when the pressure of the pilot line drops below the predetermined pressure.

12. The construction machine of claim 7, comprising:

a main pump which is driven by the engine and discharges hydraulic fluid;

a main control valve which receive the pilot pressure generated by the pilot pump and controls supply of the hydraulic fluid to the boom cylinder;

a main hydraulic line which connects the main pump and the main control valve; and a first boom hydraulic line which connects the main control valve and the head side of the boom cylinder, and a second boom hydraulic line which connects the main control valve and the rod side of the boom cylinder.

* * * * *